US010808938B2

(12) United States Patent
Lu

(10) Patent No.: US 10,808,938 B2
(45) Date of Patent: Oct. 20, 2020

(54) MULTIFUNCTIONAL ELECTRIC FIREPLACE

(71) Applicant: Dong Guan Song Wei Electric Technology Co., Ltd., Dongguan, Guangdong (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 16/198,763

(22) Filed: Nov. 22, 2018

(65) Prior Publication Data

US 2020/0166213 A1 May 28, 2020

(51) Int. Cl.
*F24C 7/00* (2006.01)
*F24B 1/18* (2006.01)

(52) U.S. Cl.
CPC ..... *F24B 1/1808* (2013.01); *F24C 7/004* (2013.01)

(58) Field of Classification Search
CPC ..... F24C 7/004; F24B 1/1808
USPC ..... 40/428; 392/398
See application file for complete search history.

(56) References Cited

U.S. PATENT DOCUMENTS 9,188,345 B1 * 11/2015 Lu ..... F24C 7/004
2004/0060213 A1 * 4/2004 Schroeter ..... F21S 10/04 40/428
2009/0080871 A1 * 3/2009 Chiu ..... F24C 7/004 392/348
2016/0169528 A1 * 6/2016 Lu ..... F24C 7/004 392/348
2016/0170510 A1 * 6/2016 Lu ..... F24C 7/004 345/173
2017/0167678 A1 * 6/2017 Gallo ..... F21S 10/046

FOREIGN PATENT DOCUMENTS

CN 202521701 U * 11/2012

* cited by examiner

*Primary Examiner* — Cassandra Davis
(74) *Attorney, Agent, or Firm* — Leong C. Lei

(57) ABSTRACT

A multifunctional electric fireplace includes a casing, a main control board, a decorative light guide plate, a light emitting device, and a simulated charcoal. The decorative light guide plate is disposed on the inner wall of an accommodating chamber of the casing, so that the light of the light emitting device is irradiated on the side of the decorative light guide plate. The main control board controls the light change of the light emitting device, so that the decorative light guide plate exhibits various statics patterns or dynamic patterns to form realistic visual effects. The functions of simulation are diverse, which can meet the requirements for aesthetics.

8 Claims, 5 Drawing Sheets

MULTIFUNCTIONAL ELECTRIC FIREPLACE

BACKGROUND OF THE INVENTION

1. Field of the Invention

The present invention relates to an electric fireplace, and more particularly to a multifunctional electric fireplace.

2. Description of the Prior Art

In the early days, a fireplace can be used for lighting, warming, baking. With the development of economy and technology, the three functions of lighting, warming, baking are gradually improved and separated. These days, a fireplace becomes warming equipment. With the development of times, fireplaces are improved from the traditional fireplaces, such as wood burning fireplaces, fuel gas fireplaces or charcoal fireplaces, to electric fireplaces. With the development of the times, electric fireplaces have basically replaced traditional fireplaces.

While enjoying the convenience of electric fireplaces, users have also put forward more modern requirements. For a conventional electric fireplace, only a single color of flame can be emitted, and the function is relatively simple, which cannot meet the requirements for aesthetics.

Accordingly, the inventor of the present invention has devoted himself based on his many years of practical experiences to solve this problem.

SUMMARY OF THE INVENTION

In view of the shortcomings of the prior art, the primary object of the present invention is to provide a multifunctional electric fireplace that can solve the problem that the conventional electric fireplace has a single function and cannot meet the requirements for aesthetic.

In order to achieve the above object, the present invention adopts the following technical solutions:

A multifunctional electric fireplace, comprising a casing, a main control board, a decorative light guide plate, a light emitting device, and a simulated charcoal. A front of the casing is recessed to form an accommodating chamber. The main control board is disposed inside the casing. The decorative light guide plate is disposed on an inner wall of the accommodating chamber. The light emitting device is disposed in the accommodating chamber and electrically connected to the main control board. The light emitting device faces at least one side of the decorative light guiding plate. The simulated charcoal is disposed on an inner bottom surface of the accommodating chamber in front of the decorative light guide plate.

Preferably, a control panel is embedded in an upper right corner of the front of the casing, and the main control board is connected to the control panel.

Preferably, the decorative light guide plate is disposed on a front inner wall or two side inner walls of the accommodating chamber.

Preferably, the decorative light guide plate is an acrylic plate, a PC plate or glass.

Preferably, the light emitting device is located on any one of four sides of the decorative light guiding plate.

Preferably, the light emitting device includes a base and a light board. The base is fixedly mounted to the inner bottom surface of the accommodating chamber. The light board is fixed on the base and faces at least one side of the decorative light guide plate. A surface of the light board has a plurality of LED lights arranged transversely. A light change of the plurality of LED lights is controlled by a CPU program on the main control board.

Preferably, the light board is a rigid printed circuit board or a flexible light strip.

Preferably, an emitting color of the LED lights is red, orange, yellow, green, blue, or a combination of multiple colors.

Preferably, the decorative light guide plate has a pattern layer.

Compared with the prior art, the present invention has obvious advantages and beneficial effects. Specifically, it can be known from the above technical solutions:

The decorative light guide plate is disposed on the inner wall of the accommodating chamber, so that the light of the light emitting device is irradiated on the side of the decorative light guide plate. The main control board controls the light change of the light emitting device, so that the decorative light guide plate exhibits various statics patterns or dynamic patterns to form realistic visual effects. The functions of simulation are diverse, which can meet the requirements for aesthetics.

Embodiments of the present invention will now be described, by way of example only, with reference to the accompanying drawings.

DETAILED DESCRIPTION OF THE PREFERRED EMBODIMENTS

Figure 1:
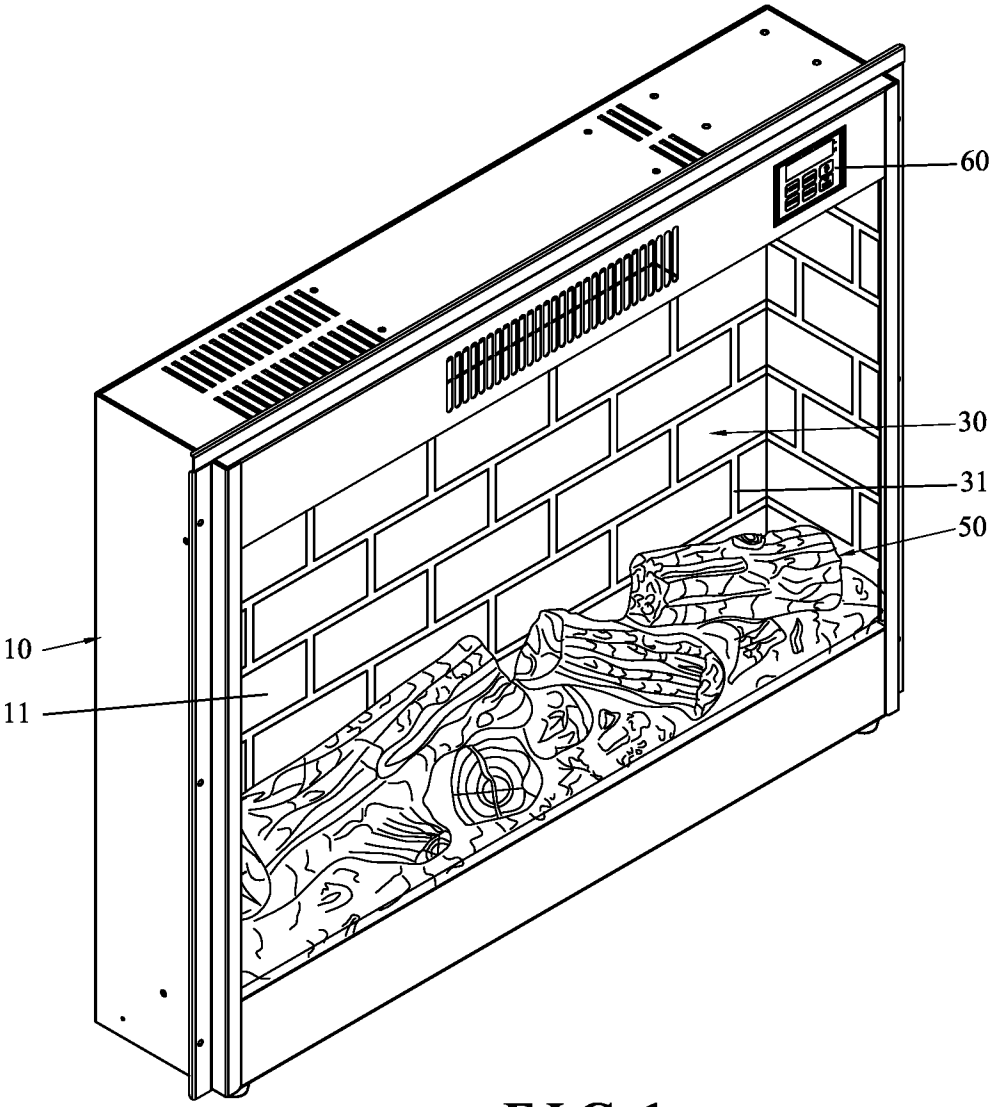
FIG. 1 is a perspective view according to a preferred embodiment of the present invention.
Figure 2:
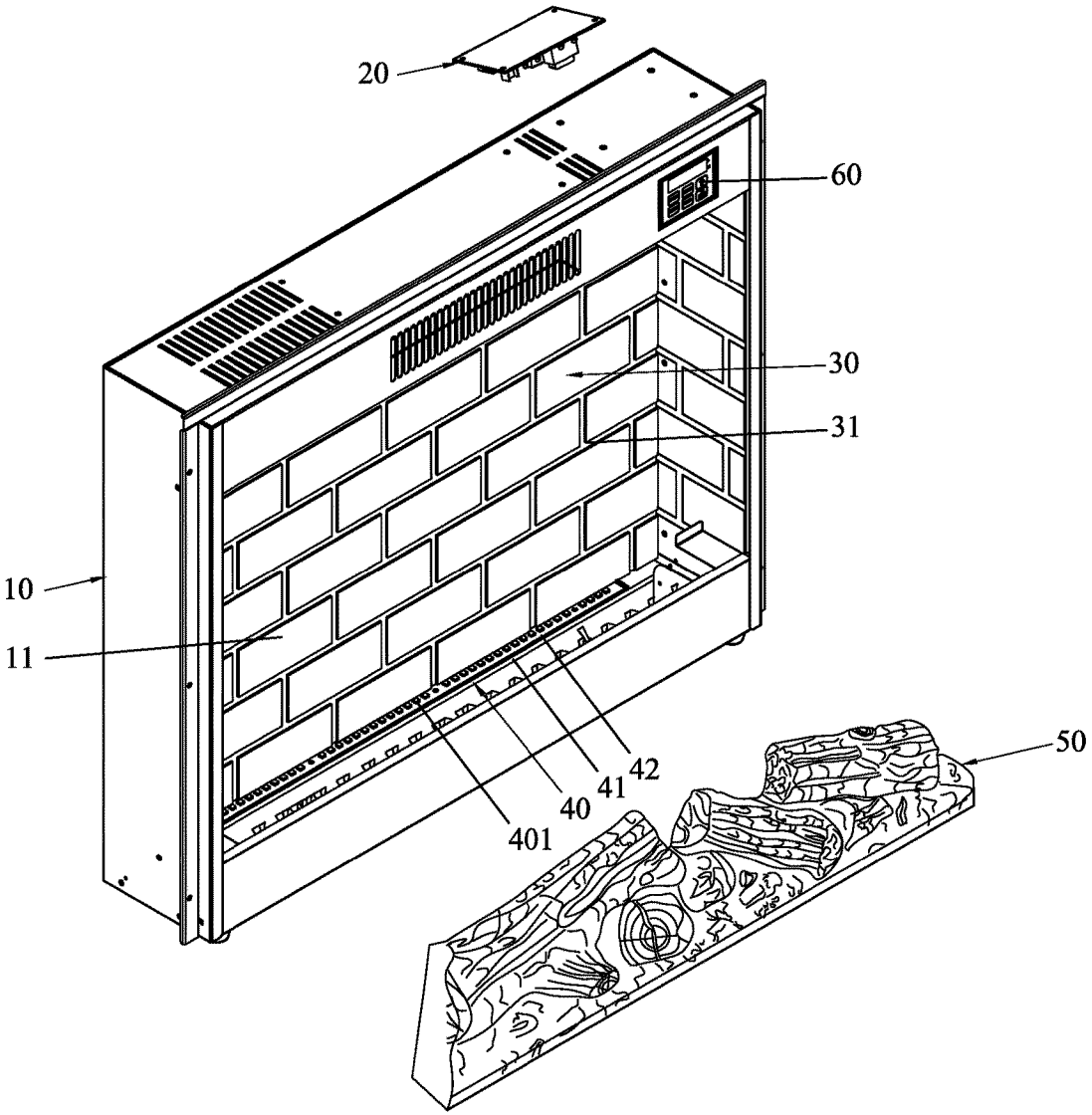
FIG. 2 is a partial assembled view according to the preferred embodiment of the present invention.
Figure 3:
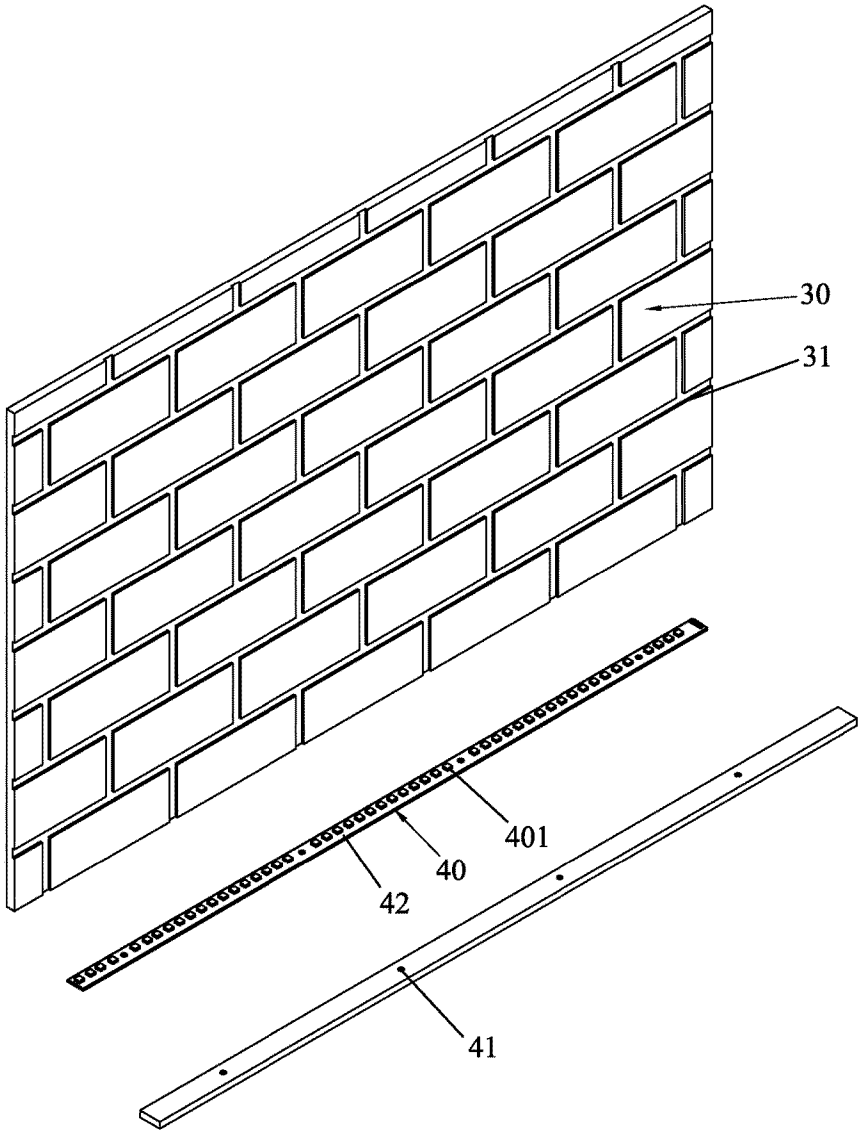
FIG. 3 is an exploded view of partial components of the preferred embodiment of the present invention.

As shown in FIG. 1 to FIG. 3, the multifunctional electric fireplace according to a preferred embodiment of the present invention comprises a casing 10, a main control board 20, a decorative light guide plate 30, a light emitting device 40, and a simulated charcoal 50.

The front of the casing 10 is recessed to form an accommodating chamber 11. A control panel 60 is embedded in the upper right corner of the front of the casing 10.

The main control board 20 is disposed inside the casing 10. The main control board 20 is connected to the control panel 60. In the embodiment, the main control board 20 is disposed inside the upper right portion of the casing 10.

Figure 4:
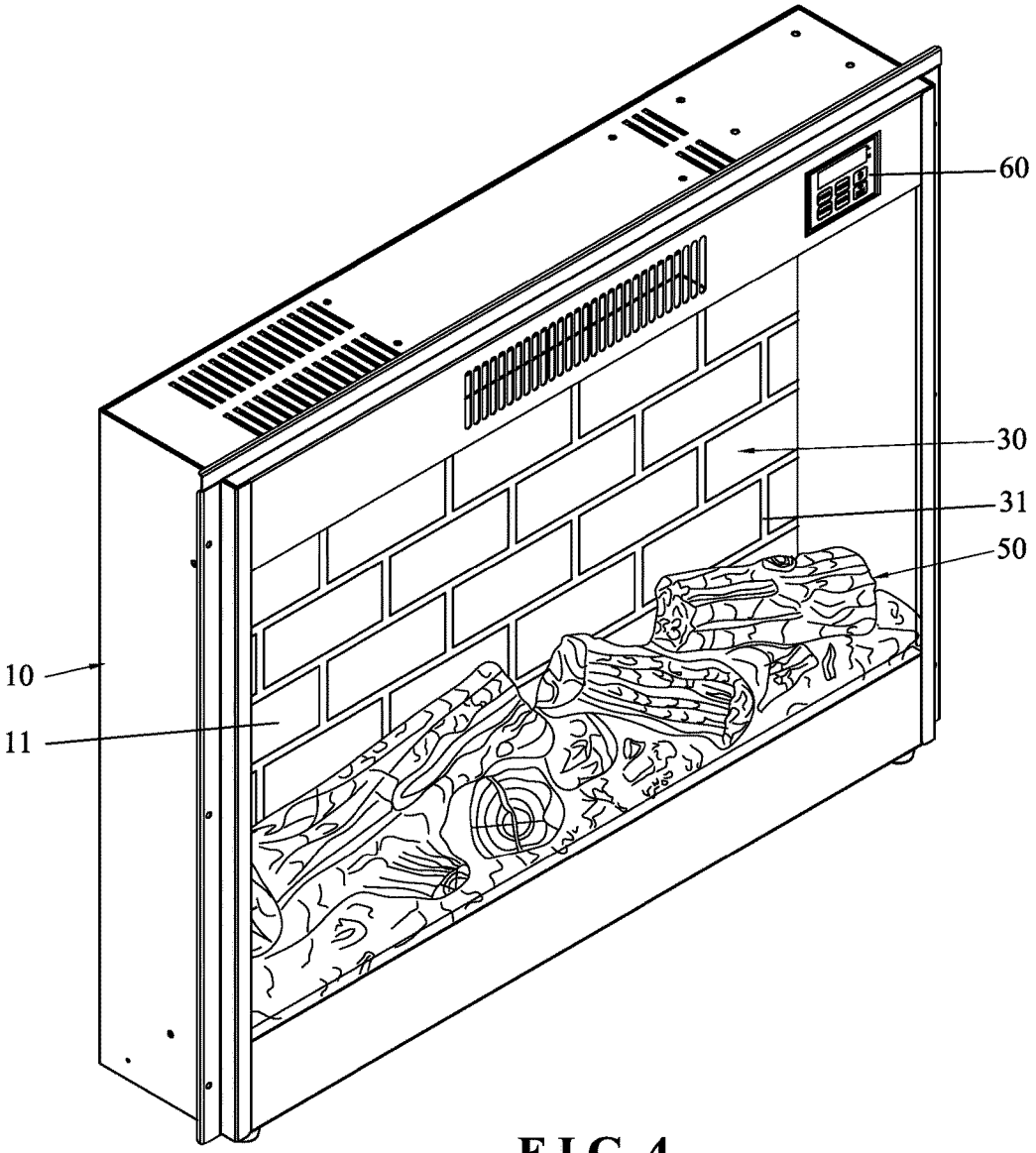
FIG. 4 is another perspective view according to a preferred embodiment of the present invention.
Figure 5:
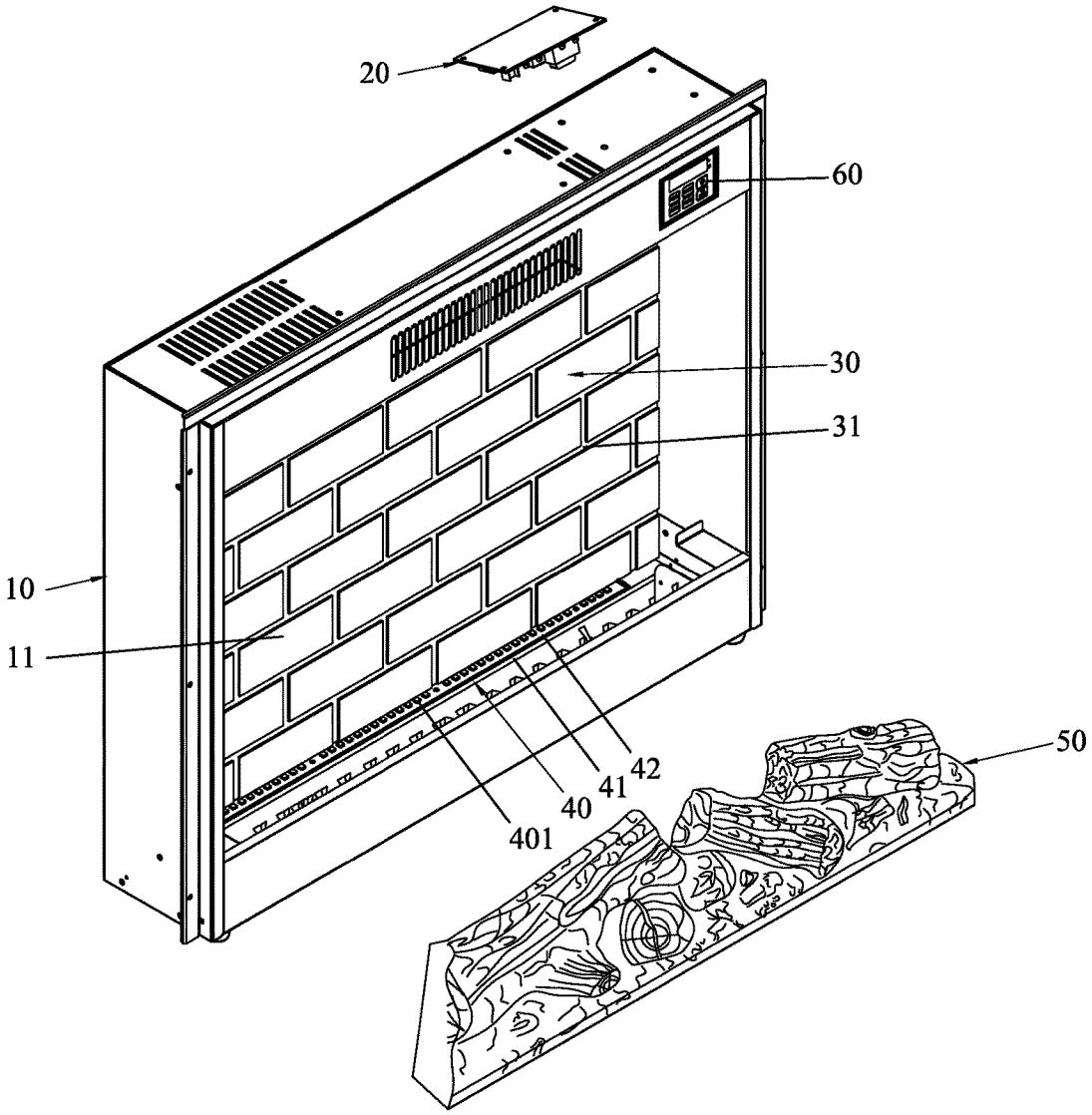
FIG. 5 is another partial assembled view according to the preferred embodiment of the present invention.

The decorative light guide plate 30 is disposed on the inner wall of the accommodating chamber 11. In the embodiment, the decorative light guide plate 30 is disposed on the front inner wall and two side inner walls of the accommodating chamber 11. The decorative light guide plate 30 may be disposed only on the front inner wall of the accommodating chamber 11 (as shown in FIGS. 4 and 5) or only on the two side inner walls of the accommodating chamber 11. The decorative light guide plate 30 has a pattern layer 31. The pattern of the pattern layer 31 may be various patterns, such as wall tiles, stones, snowflakes, crystals, firewood, and the like. The decorative light guide plate 30 is an acrylic plate, a PC plate or glass, but not limited thereto. The decorative light guide plate 30 is made of a transparent or translucent material. When the light projects on either side of the decorative light guide plate 30, the pattern on the decorative light guide plate 30 can be displayed.

The light emitting device 40 is disposed in the accommodating chamber 11 and electrically connected to the main control board 20. The light emitting device 40 faces at least one side of the decorative light guiding plate 30. The light emitting device 40 may be located on any one of four sides of the decorative light guiding plate 30. In this embodiment, the light emitting device 40 is located below the bottom edge of the decorative light guide plate 30. The light emitting device 40 includes a base 41 and a light board 42. The base 41 is fixedly mounted to the inner bottom surface of the accommodating chamber 11. The light board 42 is fixed on the base 41 and faces at least one side of the decorative light guide plate 30. The surface of the light board 42 has a plurality of LED lights 401 arranged transversely. The light change of the plurality of LED lights 401 is controlled by the CPU program on the main control board 20, or the light control chip is directly provided on the light board 42 to control the light change of the plurality of LED lights 401. Specifically, the light board 42 may be a rigid printed circuit board or a flexible light strip. The LED lights 401 may be packaged on the light board 42 by an insert or patch.

In this embodiment, the main control board 20 is provided with a light change control generation unit. The light change control generation unit comprises a voltage stabilizing circuit, a program control integrated chip, and a light control load circuit. The device for driving the LED lights 401 to emit light is an integrated driving IC or a triode. The change signal output from the single chip microcomputer is transmitted to the input control pin of the integrated driving IC or the triode, which controls the load resistor RL of the LED lights 401 to gradually change, or cut off or conduct, and enables the integrated driving IC or triode to conduct or cut off or gradually change to achieve the dynamic change of the light load resistor RL. The emitting color of the LED lights 401 may be red, orange, yellow, green, blue, or a combination of multiple colors.

The simulated charcoal 50 is disposed on the inner bottom surface of the accommodating chamber 11 in front of the decorative light guide plate 30.

The working process of this embodiment is as follows:

First, the electric fireplace is energized and activated by a switch on the control panel 60. The LED lights 401 gradually change under the control of the main control board 20. The diffused light with a gradual change is irradiated on the side of the decorative light guide plate 30. The pattern layer 31 on the decorative light guide plate 30 is automatically displayed, and the light simulates the color of the wall tiles to change or dim up or dim down. From the front of the product, a static pattern or a dynamic pattern appears on the decorative light guide plate 30 to form a realistic visual effect. For example, the changing scene of the pattern will slowly disappear, change or fade, forming a realistic flame change effect and forming a realistic combustion chamber effect with simulated charcoal 50.

The features of the present invention are described below.

The decorative light guide plate is disposed on the inner wall of the accommodating chamber, so that the light of the light emitting device is irradiated on the side of the decorative light guide plate. The main control board controls the light change of the light emitting device, so that the decorative light guide plate exhibits various statics patterns or dynamic patterns to form realistic visual effects. The functions of simulation are diverse, which can meet the requirements for aesthetics.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multifunctional electric fireplace, comprising a casing, a main control board, a decorative light guide plate, a light emitting device, and a simulated charcoal; a front of the casing being recessed to form an accommodating chamber; the main control board being disposed inside the casing; the decorative light guide plate being disposed on an inner wall of the accommodating chamber; the light emitting device being disposed in the accommodating chamber and electrically connected to the main control board, the light emitting device facing at least one side of the decorative light guiding plate; the simulated charcoal being disposed on an inner bottom surface of the accommodating chamber in front of the decorative light guide plate;

wherein the light emitting device is located below a bottom edge of the decorative light guide plate and comprises a plurality of LED lights facing the bottom edge of the decorative light guide plate to selectively irradiate the bottom edge of the decorative light guide so as to illuminate a pattern layer formed on a front surface of the decorative light guide plate, wherein the decorative light guide plate comprises two side portions extending respectively from two opposite lateral edges thereof, wherein the decorative light guide plate being disposed on a front inner wall of the accommodating chamber and the two side portions of the decorative light guide plate are respectively disposed on two side inner walls of the accommodating chamber.

2. The multifunctional electric fireplace as claimed in claim 1, wherein a control panel is embedded in an upper right corner of the front of the casing, and the main control board is connected to the control panel.

3. The multifunctional electric fireplace as claimed in claim 1, wherein the decorative light guide plate is an acrylic plate, a PC plate or glass.

4. The multifunctional electric fireplace as claimed in claim 1, wherein the light emitting device is located on any one of four sides of the decorative light guiding plate.

5. The multifunctional electric fireplace as claimed in claim 1, wherein the light emitting device includes a base and a light board, the base is fixedly mounted to the inner bottom surface of the accommodating chamber, the light board is fixed on the base and faces at least one side of the decorative light guide plate, the plurality of LED lights being arranged transversely on a surface of the light board, and a light change of the plurality of LED lights is controlled by a CPU program on the main control board.

6. The multifunctional electric fireplace as claimed in claim 5, wherein the light board is a rigid printed circuit board or a flexible light strip.

7. The multifunctional electric fireplace as claimed in claim 6, wherein an emitting color of the LED lights is red, orange, yellow, green, blue, or a combination of multiple colors.

8. The multifunctional electric fireplace as claimed in claim 1, wherein the decorative light guide plate comprises a first part disposed on a front inner wall of the accommodating chamber and two second parts respectively disposed on two side inner walls of the accommodating chamber.

* * * * *